United States Patent [19]

Tutikawa

[11] Patent Number: 4,697,384

[45] Date of Patent: Oct. 6, 1987

[54] FLAT SLIDING DOOR UNIT

[76] Inventor: Yosiji Tutikawa, Osaka, Japan

[21] Appl. No.: 856,933

[22] Filed: Apr. 25, 1986

[51] Int. Cl.[4] ..... E05D 15/20

[52] U.S. Cl. ..... 49/130; 49/127

[58] Field of Search ..... 49/127, 130

[56] References Cited

U.S. PATENT DOCUMENTS 880,350 2/1908 Balch ..... 49/130

3,122,795 3/1964 Harle ..... 49/130

*Primary Examiner*—Kenneth Downey

*Attorney, Agent, or Firm*—Lowe, Price, LeBlanc, Becker & Shur

[57] ABSTRACT

A flat sliding door unit comprising an upper suspension secured to the upper frame on the front of a furniture, a lower suspension secured to the lower frame on the front, and a pair of sliding doors disposed on the right and left sides and supported by the suspensions, the upper suspension comprising a straight rail extending in the right and left directions, a pair of side rails disposed on the right and left sides and extending rearwardly from the central part of the straight rail, and a pair of pointers for switching the door path from the straight rail to side rails, the lower suspension comprising a straight rail extending in the right and left directions, a side space formed to extend rearwardly from the central part of the straight rail, and side paths formed to extend obliquely rearwardly from both ends of the straight rail, and, the right- and left-hand sliding doors each being provided, at both lower ends, with a pair of lower sliding bodies to slide along the rail of the lower suspension and, further, with at least one upper sliding body to slide along the rail of the upper suspension at an upper end thereof abutting on the adjacent door.

6 Claims, 9 Drawing Figures

FLAT SLIDING DOOR UNIT

BACKGROUND OF THE INVENTION

This invention relates to a flat sliding door unit used on furniture or fittings, and more particularly to a flat sliding door unit arranged in such manner that a door in a flat closed state on one side can be slid to the front side of another door on the other side.

Various kinds of door units of the two-step action type, in which a door on one side in a flat closed state, when about to be opened, is drawn to one side at an edge thereof adjacent to another door on the other side and then slid to be opened are well known. However, these prior known doors are not satisfactory because of a variety of merits and demerits thereof.

Therefore, a flat sliding door unit, to be deserving as a practical commercial article, must satisfy such requirements as follows:

The unit must be simple in mechanism, easy to apply to furniture and the like, and smooth in motion. Further, the sliding doors must be retained in a stable state.

For instance, a unit disclosed in the Japanese Patent Application, Laid-open No. 59-141679, exhibits drawbacks in that not only is the structure thereof complicated, but the sliding doors are each supported on a cantilever in an unstable manner (the door is provided with rollers at the central part and on an end, thereby freely swaying at the foremost guiding end for opening) and lack smoothness in motion.

SUMMARY OF THE INVENTION

A primary object of this invention is to provide a flat sliding door unit capable of satisfying the above-described requirements while eliminating drawbacks as described above in the conventional flat sliding door unit.

DESCRIPTION OF THE PREFERRED EMBODIMENT

Figure 1:
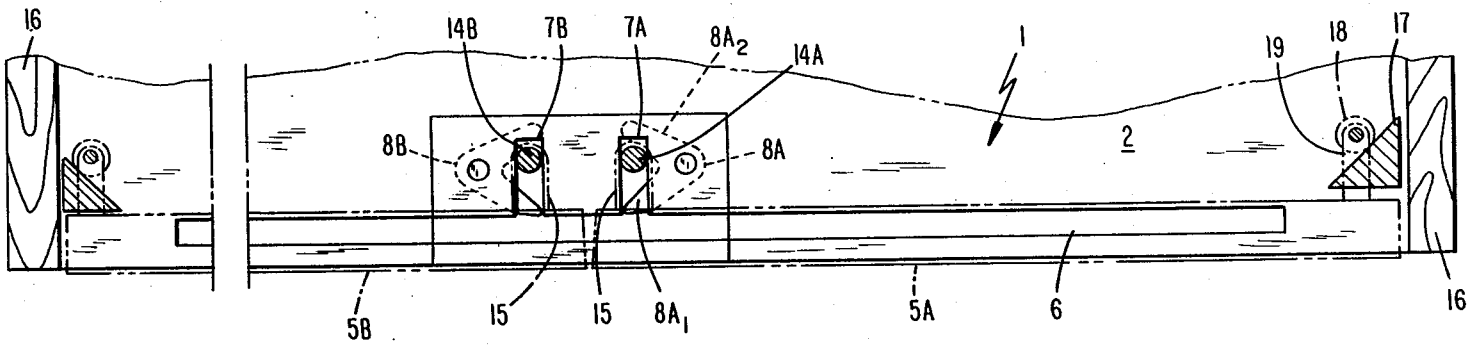
FIG. 1 is a plan view of the upper suspension in a flat sliding door unit of this invention as seen from the lower side.

FIGS. 1 through 5 show a first embodiment of this invention, in which reference numeral 1 designates an upper suspension fixed to an upper rail 2 on the front of a piece of furniture or fittings; a lower suspension 3 is fixed to the lower rail 4 on the abovesaid front; and 5A and 5B, a pair of sliding doors lying on the right and left, are supported by these suspensions.

The upper suspension 1 comprises a straight rail 6 extending in the right and left directions, a pair of side rails 7A and 7B extending rearwardly from the central part of the straight rail at an approximate right angle, and a pair of pointers 8A and 8B for switching the door path from the straight rail to side rails.

The lower suspension 3 comprises a straight rail 9 extending in the right and left directions, a side space 10 formed in the rear of the central part of the straight rail, and lead in side rails 11A and 11B formed to extend obliquely rearwardly from both ends of the straight rail.

The right and left sliding doors 5A and 5B are each provided, at both lower ends, with a pair of lower sliding bodies 12A and 12A', or 12B and 12B', to slide along the rail s 9 and 11A, or 9 and 11B, of the lower suspension 3 through a supporting arm 13, and, at an upper end abutting on the upper end of another door, with an upper sliding body 14A or 14B to slide along the rails 6 and 7A, or 6 and 7B, of the upper suspension 1 through the supporting arm 15. In this first embodiment, the straight rail 6 extends between positions near the side walls 16, slanting guide surfaces 17A and 17B extend rearwardly from the vicinities of respective ends of the straight rail 6, and contact members 18A and 18B in contact with the slanting guide surfaces are each disposed on one upper end of the sliding door 5A or 5B abutting on one of the abovesaid side walls 16 through the supporting arm 19. In the drawing, the contact member is composed of a ring to rotate around a vertical axis.

In the above embodiment, sliding bodies 14A and 14B of the upper suspension may each be a ring formed of an axis.

Figure 2:
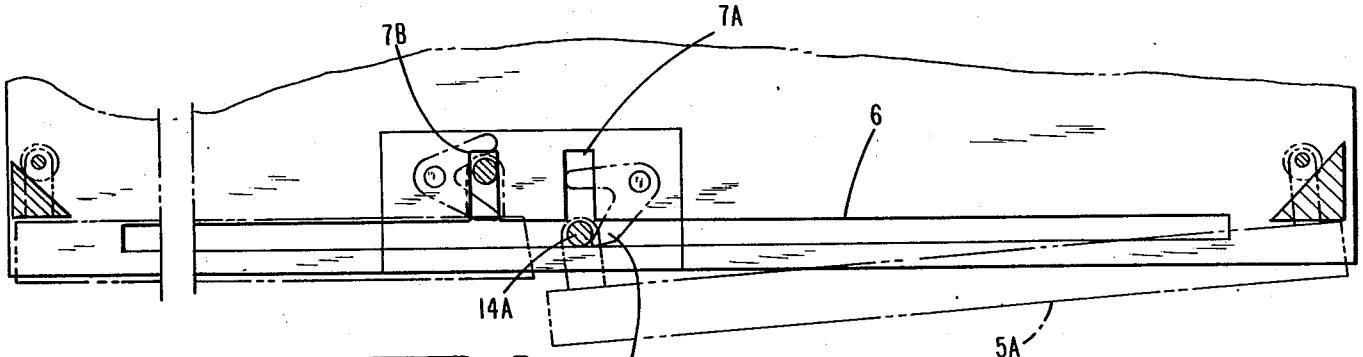
FIG. 2 is a view of the unit in operation.
Figure 3:
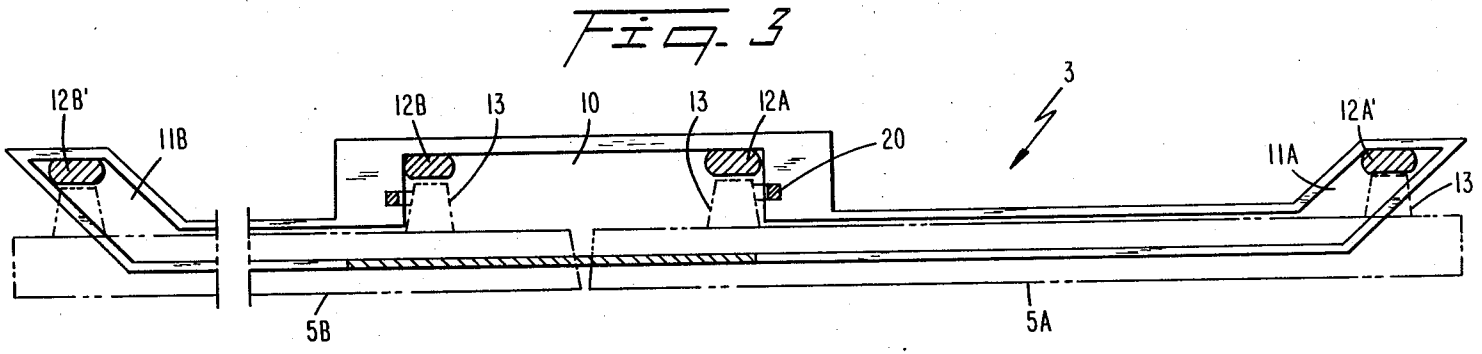
FIG. 3 is a plan view of the lower suspension.

In FIGS. 1 and 3, the sliding doors are in a closed state. When any one of the doors, for example, a sliding door 5A on the right side, is intended to be opened, a sliding body 14A, on pulling of an end portion of the door abutting on the adjacent door to one side (lower side on the drawing), pushes a part $8A_1$ of the pointer 8A and turns it for shifting to the straight rail 6 (See FIG. 2). Sliding body 12A of the lower suspension 3 is shifted to the same path as the straight rail 9 (See FIG. 4). Then, the sliding door 5A, when moved sideways, can be opened to lie in front of the other sliding door 5B on the left side. At this time, sideways movement of the door along the straight rail can be performed by providing a sliding member 20 for a supporting stay 13 disposed on the end abutting on the adjacent door and supporting the sliding body 12, and by adapting this sliding member to slide while touching the front side of a raised part 21 formed on the approximate while of the front area of side space 10 when the door is moved sideways. Also, in the upper suspension 1, at the time of displacement of the right sliding door 5A, an exit of the left-hand side rail 7B is closed by the pointed 8B and, therefore, the right-hand sliding body 14A is exactly moved in a straight direction.

Figure 4:
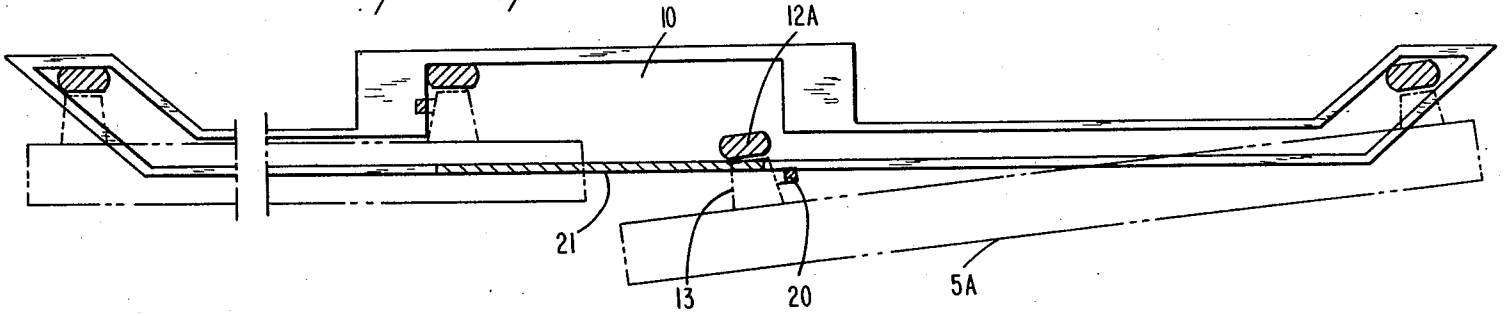
FIG. 4 is a view of the unit in operation.
Figure 5:
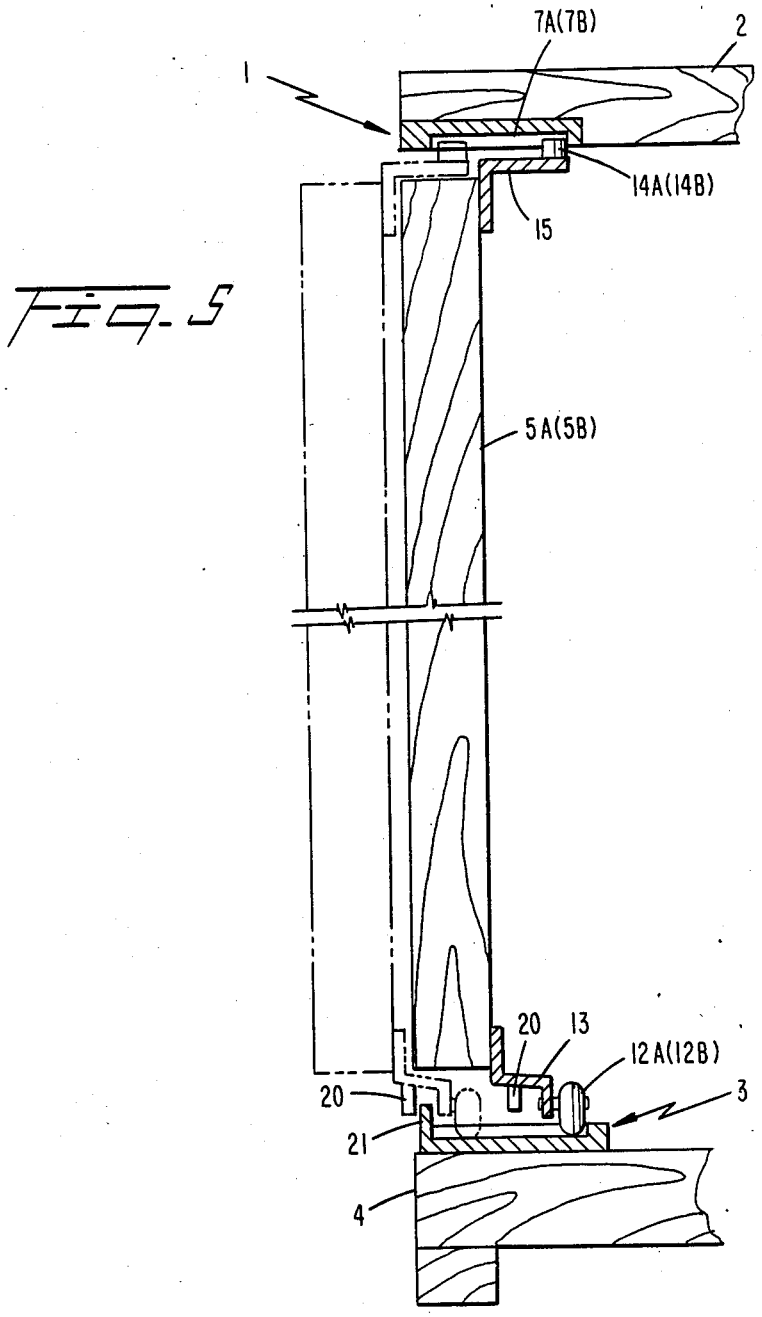
FIG. 5 is a vertical sectional view thereof.

On the other hand, the sliding door 5A in an open state, when drawn to the right side, returns to a half-open state as shown in FIGS. 2 and 4, and, when pushed at the end thereof adjacent to the neighboring door, returns to the initial closed state as shown in FIGS. 1 and 3. At this time, another part $8A_2$ of the pointer 8A returns to the initial position while thrusted by the sliding body 14A.

Figure 6:
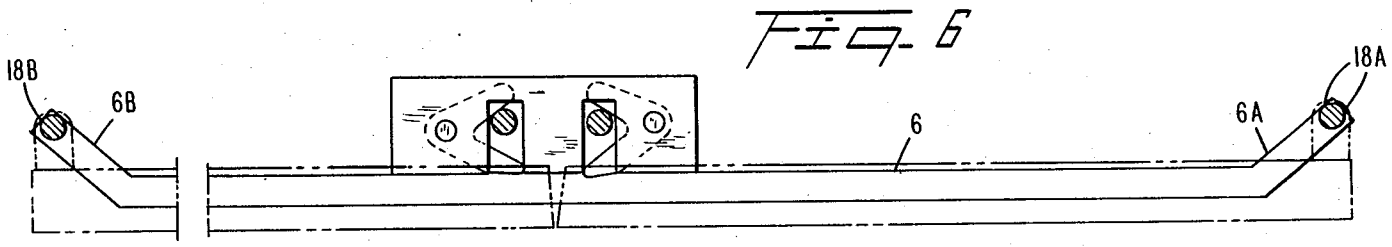
FIGS. 6 and 7 are plan view of other embodiments of the upper suspension.

FIG. 6 shows a structure in which both ends of the straight rail 6 are extended obliquely rearwardly for providing side paths 6A and 6B instead of slanting guide surfaces 17 of the upper suspension, and sliding bodies 18A and 18B slidably fitted into the abovesaid side paths are secured to the sliding doors 5A and 5B, respectively.

Figure 7:
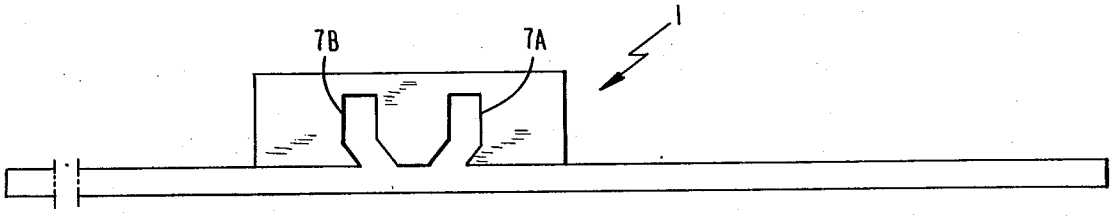

Also, FIG. 7 shows a structure in which exit parts of the side rails 7A and 7B of the upper suspension are formed to extend obliquely toward the central part of the straight rail. As a result, the sliding door is drawn to one side while slightly moved sideways, whereby changeover of the pulling action into sideway slide action may be performed smoothly.

Figure 9:
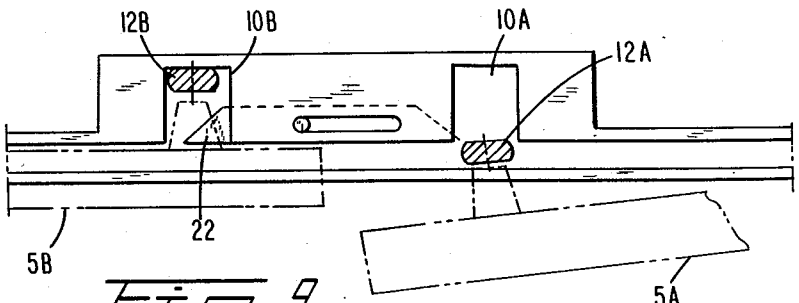
FIGS. 8 and 9 are plan views of other embodiments of the lower suspension.
Figure 8:
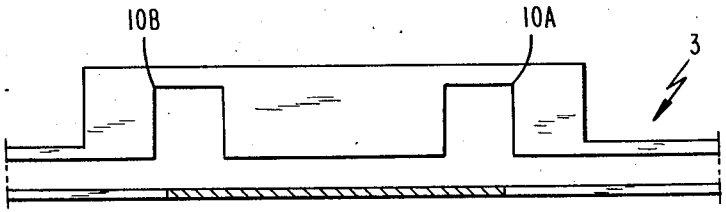

Moreover, in the lower suspension 3, the central portion of the side space 10 may be filled up to be transformed into a pair of side spaces 10A and 10B on the right and left sides. In this case, instead of the raised part 21 and the slide contact piece 20 referred to in the first embodiment, a shutter 22 may be provided for alternately closing exits of the side spaces 10A and 10B depending on incoming and outgoing movements of the sliding bodies 12A and 12B as shown in FIG. 9.

A structure according to this invention as described above permits a smooth and exact operation of sliding doors stably supported by the upper and lower suspensions and easy mounting of doors on the furniture or fittings because of the combination of the upper and lower suspensions in an uncomplicated structure, while achieving these effects in a unit provided at low cost.

What is claimed is:

1. A flat sliding door unit comprising an upper suspension secured to the upper frame on the front of a furniture or fittings, a lower suspension secured to the lower frame on said front, and a pair of sliding doors disposed on the right and left sides and supported by said suspensions.

said upper suspension comprising a straight rail extending in the right and left directions, a pair of side rails disposed on the right and left sides and extending rearwardly from the central part of said straight rail, wherein outermost ends of said side rails lie along a central longitudinal axis of said side rails which longitudinal axes form an oblique angle with the longitudinal axis of the straight rail, and a pair of pointers for switching the door path from said straight rail to side rails, said lower suspension comprising a straight rail extending in the right and left directions, a side space formed to extend rearwardly from the central part of said straight rail, and side paths formed to extend obliquely rearwardly from both ends of said straight rail, and, said right- and left-hand sliding doors each being provided, at both lower ends, with a pair of lower sliding bodies to slide along the rail of said lower suspension and, further, with at least one upper sliding body to slide along the rail of said upper suspension at an upper end thereof abutting on the adjacent door.

2. A flat sliding door unit as set forth in claim 1, wherein said pointers are each provided with a spring to be resiliently retained in position so that said pointers can switch the door paths.

3. A flat sliding door unit as set forth in claim 1, wherein said straight rail of the upper suspension are provided, at both ends, with side paths contiguous to said straight rail and extending obliquely rearwardly and, further, with sliding bodies to slide along said rail and each disposed at an upper end abutting on the side wall of the furniture or fittings.

4. A flat sliding door unit as set forth in claim 1, wherein slanting guide surfaces extend rearwardly from portions near both ends of the straight rail of the upper suspension are provided on the upper frame and contact members in contact with said slanting guide surfaces are each provided at an upper end adjacent to one of side walls of the furniture or fittings.

5. The door unit of claim 1, wherein the side rails of the upper suspension are defined by separate members (17), respectively.

6. The door unit of claim 1, wherein said lower suspension includes a shutter enabling entry of only one of said doors at a time into the side space, said shutter being a single sliding member having a sliding direction of travel generally parallel to the straight rail.

* * * * *